US005670023A

United States Patent [19]

Steiner et al.

[11] Patent Number: 5,670,023

[45] Date of Patent: *Sep. 23, 1997

[54] PRESS OF A PAPER MACHINE FOR THIN PAPERS

[75] Inventors: Karl Steiner, Herbrechtingen; Albrecht Meinecke, Heidenheim, both of Germany; Rui Goncalves, Sao Paulo, Brazil; Christian Schiel, Heidenheim, Germany

[73] Assignee: Voith Sulzer Papiermaschinen GmbH, Germany

[ * ] Notice: The term of this patent shall not extend beyond the expiration date of Pat. No. 5,500,092.

[21] Appl. No.: 374,656

[22] PCT Filed: May 27, 1994

[86] PCT No.: PCT/EP94/01730

§ 371 Date: Jan. 30, 1995

§ 102(e) Date: Jan. 30, 1995

[87] PCT Pub. No.: WO94/28240

PCT Pub. Date: Dec. 8, 1994

[30] Foreign Application Priority Data

May 29, 1993 [DE] Germany ..... 43 18 036.1
Jun. 26, 1993 [DE] Germany ..... 43 21 402.9

[51] Int. Cl.[6] ..... D21F 3/04

[52] U.S. Cl. ..... 162/359.1; 162/358.3; 162/360.3

[58] Field of Search ..... 162/358.3, 358.5, 162/359.1, 360.3, 206, 111; 34/111, 116

[56] References Cited

U.S. PATENT DOCUMENTS

| | | | |
|---|---|---|---|
| 2,209,757 | 7/1940 | Berry | 162/360.3 |
| 3,861,996 | 1/1975 | Dorfel | 162/360.3 |
| 4,483,745 | 11/1984 | Wicks et al. | 162/358.3 |
| 4,874,470 | 10/1989 | Skaugen | 162/360.3 |
| 4,880,502 | 11/1989 | Wedel | 162/358.3 |
| 4,976,820 | 12/1990 | Laapotti | 162/360.3 |
| 5,120,400 | 6/1992 | Laapotti | 162/360.3 |
| 5,308,450 | 5/1994 | Braun et al. | 162/360.3 |
| 5,368,697 | 11/1994 | Steiner et al. | 162/360.3 |
| 5,500,092 | 3/1996 | Schiel | 162/360.3 |
| 5,501,775 | 3/1996 | Kotitschke et al. | 162/360.3 |

FOREIGN PATENT DOCUMENTS

| | | | |
|---|---|---|---|
| 55206 | 6/1982 | European Pat. Off. | 162/360.3 |
| 295540 | 3/1915 | Germany . | |
| 750222 | 5/1944 | Germany . | |
| 9206340 | 9/1992 | Germany | 162/360.3 |
| 4224730 | 9/1993 | Germany . | |
| 4321402 | 12/1993 | Germany . | |
| 9312289 | 6/1993 | WIPO . | |

*Primary Examiner*—Karen M. Hastings
*Attorney, Agent, or Firm*—Ostrolenk, Faber, Gerb & Soffen, LLP

[57] ABSTRACT

The press section of a paper machine for thin papers has the following characteristics: a pressing gap is formed by a rotary, smooth surface (1) in contact with the paper and by a felted pressing roll (3); the smooth surface (1) transfers the paper web downstream of the pressing gap to a heatable roll (4) without free pulling of the paper web. The invention is characterized in that the smooth surface (1) is the outer surface of a tubular roll with dimensionally stiff roll sleeve.

10 Claims, 3 Drawing Sheets

PRESS OF A PAPER MACHINE FOR THIN PAPERS

BACKGROUND OF THE INVENTION

The present invention relates to a press section of a paper machine for thin papers, particularly one-sided papers or tissue, and in particular to the removal of the web from the last press unit.

Press sections in paper machines in which the water is discharged to one side of the web have been known for a long time. By way of example, reference is had to the journal "Wochenblatt für Papierfabrikation 5 (1988)", pages 173 et seq. In that case, the web is removed from the smooth roll following the press nip in a free path in order, for instance, to be fed to a smoothing press, a drying cylinder or a multi-unit drying section.

The disadvantage of these embodiments is that special transfer elements for the web are necessary and that the frequency of web tears is relatively great.

Reference is furthermore had to German Patent Application DE 42 24 730 C1, FIG. 8 of which shows the removal of the web of paper from a roll by a press hose of a long-nip press 13.3. Here there is the disadvantage that the life of the press hose is greatly reduced by contact with the hot surface of the following cylinder 20.

SUMMARY OF THE INVENTION

The object of the present invention is to provide a press section with which such transfer elements can be dispensed with, so that the frequency of the tearing of the web of paper is reduced, and at the same time, there is a saving in cost due to a reduction in the operating expenses.

This object is achieved by the features set forth in the following. In the press section of a paper machine, a first press nip is defined between a smooth surfaced, tubular roll and a felted press roll. A following heatable roll has the web transferred to it from the smooth surfaced roll.

In accordance with the invention, it is proposed by the inventors that, instead of a free path, the web is removed by a tubular press roll, particularly a roll having a rigid shell, from the smooth roll of the last press and is fed to the next machine group, for instance the smoothing unit, smoothing press, drying cylinder, or a multi-unit drying section.

In this way, the following advantages are obtained:

The heatable roll (for instance, a drying or smoothing cylinder) to which the paper is transferred from the tubular press roll does not come into contact with a felt or with a "press hose" or "press shell".

The felt need pass only through a single press nip.

As a result, there is a longer life both of the press shell and of the felt.

In accordance with the concept of the invention, the following possible embodiments result for a press section for preferably thin papers, particularly also tissue papers:

First, a press nip is provided which is formed by a rotating, smooth paper-contacting surface and a felted press roll. The smooth surface transfers the web of paper, avoiding a free paper path, i.e. an open draw, after the press nip to a heatable roll, the smooth surface is developed as the outer surface of a tubular roll having a dimensionally stiff roll sleeve.

It is advantageous for the felted press roll to be a long-nip or shoe press roll.

Furthermore, it is particularly advantageous if, with a press section developed in this manner, the smooth tubular roll forms, prior to the press nip, another prior press nip (pre-press nip) with a further felted press roll. In this connection it is also advantageous if separate, endless loop felts are provided for the two press nips. However, a single felt for both press nips may also be advantageous, depending on the operating conditions. It may be particularly advantageous with respect to the drying power if the further felted press roll is also a shoe-press or long-nip press roll.

It may also be advantageous for the further felted press roll to be a suction roll having a suction zone which lies predominantly in front of the pre-press nip. In the embodiments shown, it may also be advantageous to develop the smooth tubular roll as a sag-adjustment roll in order to obtain the uniform linear pressures and in this way improve the transfer of the web. Another advantageous development of the press section is obtained if the heatable roll is a non-felted tubular roll which conducts the web and transfers the web to a drying cylinder, a free paper path being preferably avoided. In this case, it may also be advantageous for the heatable roll to form a post-press nip with an additional felted press roll.

In the embodiments shown, it may also be advantageous for the nip between the smooth tubular roll and the heatable roll, particularly of a drying cylinder, to be adapted to be opened; as indicated by the arrow 40 in FIG. 1, so as to facilitate starting without paper.

BRIEF DESCRIPTION OF THE DRAWINGS

The invention will be further explained with reference to the drawings, in which.

DETAILED DESCRIPTION

Figure 1:
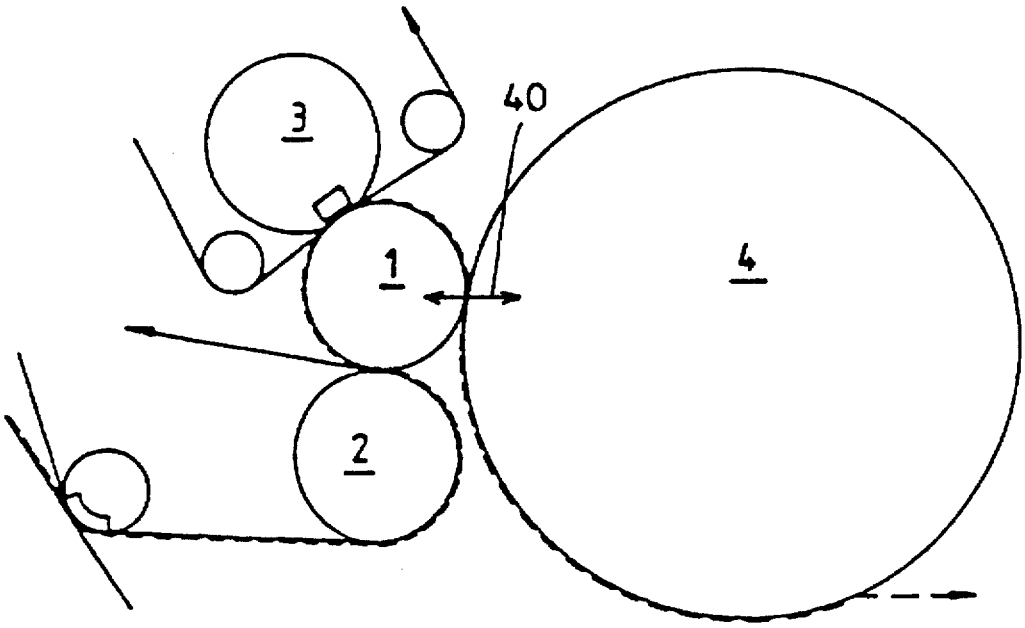
FIGS. 1 to 7 show variant embodiments of the transfer of the web between the press section and the following paper machine section with smooth rolls.

FIG. 1 shows the last press section of a paper machine having a smooth central roll 1 which is a tubular roll and one with a outer shell of rigid shape. Together with another roll 2, the roll, forms a prior press nip together with a single felt passing through that nip. The roll 2 can in this connection be a suction roll or a blind-hole roll. The paper web then remains lying on the smooth roll 1 and is fed to a final press nip which is formed by the roll 1 and a long-nip press 3. The paper web then continues to lie on the smooth roll and is led out in accordance with the invention to a large smoothing cylinder 4, which can also be developed as a tissue cylinder.

Figure 2:
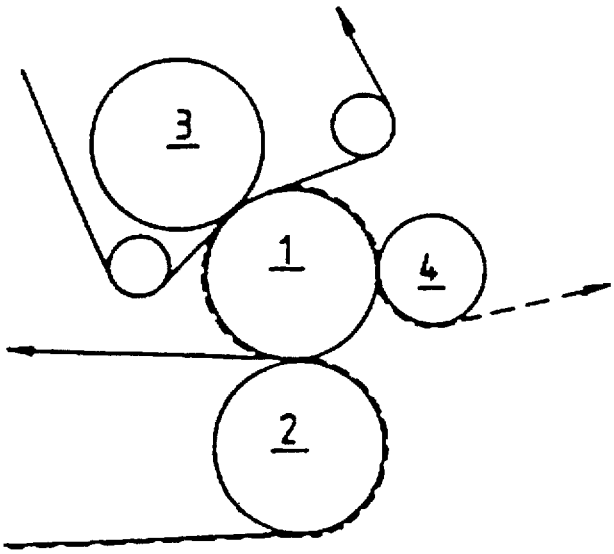

FIG. 2 shows an arrangement which is similar to FIG. 1, but the last press nip between the central roll 1, which is also developed as a tubular roll, and the backing roll 3 is not developed as a long-nip press, but instead as a so-called smoothing press. In the same way as in FIG. 1, the paper web remains on the smooth central roll 1 after the last press nip and is then transferred to, for instance, a heated cylinder 4. As an alternative, there is also the possibility here of transferring the paper web directly from the cylinder 4 to a following smoothing cylinder.

Figure 3:
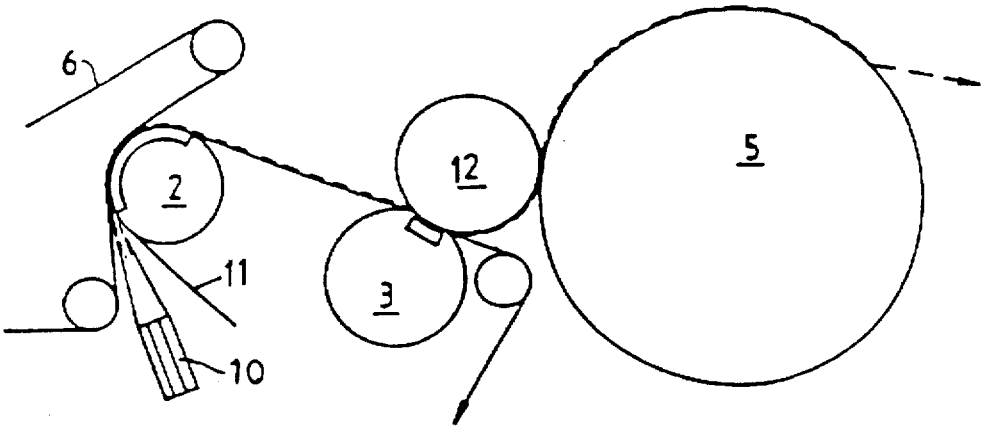

FIG. 3 shows a special embodiment of the transfer in accordance with the invention. This figure shows the starting end of a paper machine in which pulp slurry is introduced via a headbox 10 between two wires 6, 11 which rest against a breast roll. The paper web is transported further lying on this first felt up to the last press nip, which in this case is formed by a long-nip press 3 and the smooth tubular roll 12 of the invention. Possible devices between the last press nip and the headbox are not shown here. After the last press nip, the web of paper passes in accordance with the invention over the smooth roll 12 directly to a following cylinder 5. The roll 12 can preferably be developed as a sag-adjustment roll so as to assure as uniform as possible pressure, particularly on the following cylinder 5.

Figure 4:
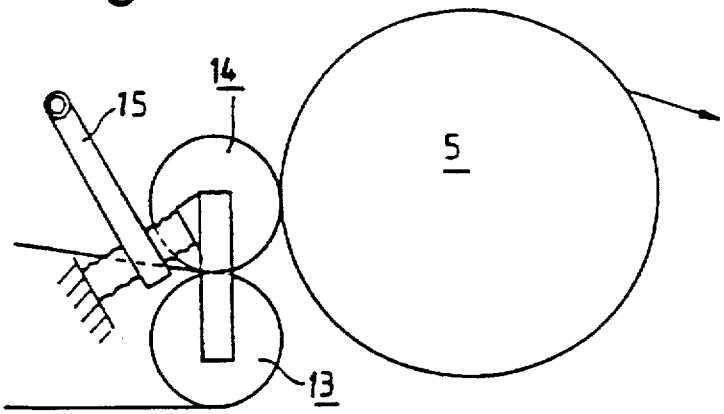

FIG. 4 shows a last press nip of a press section. It shows a press unit between two cylinders 13 and 14. The cylinder 14 represents the smooth cylinder with its surface of rigid shape in accordance with the invention. The two cylinders 13 and 14 are here provided, in accordance with the invention, on a movable lever arm 15 so that they can be moved as a unit towards and away from the following large cylinder without the press nip between the two cylinders 13 and 14 changing.

Figure 5:
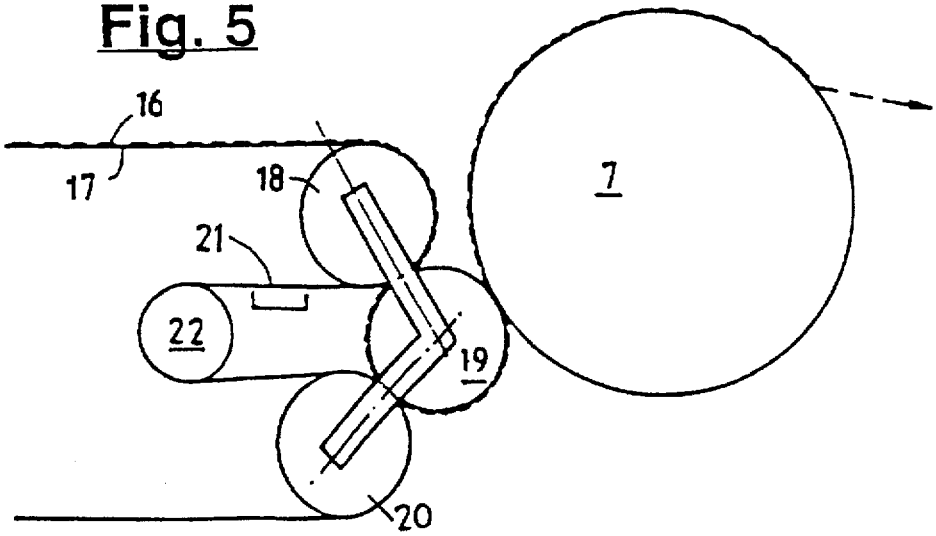

FIG. 5 shows another variant of the invention. A felt 17 bearing a paper web 16 coming from the left is shown. The felt 17 conducts the web of paper from above to a cylinder 18 which forms a penultimate press nip with the following smooth tubular roll 19 of the invention. After the penultimate press nip, the web of paper is conducted directly to the last press nip between the smooth tubular roll 19 and the following roll 20. The felt travels over a conditioning device 21 and a reversing roll 22 where it is separate from the paper web back to the last press nip over the roll 20 and the felt is returned from there, while the web of paper remains on the smooth roll 19 and is transferred directly to the following drying cylinder 7.

Figure 6:
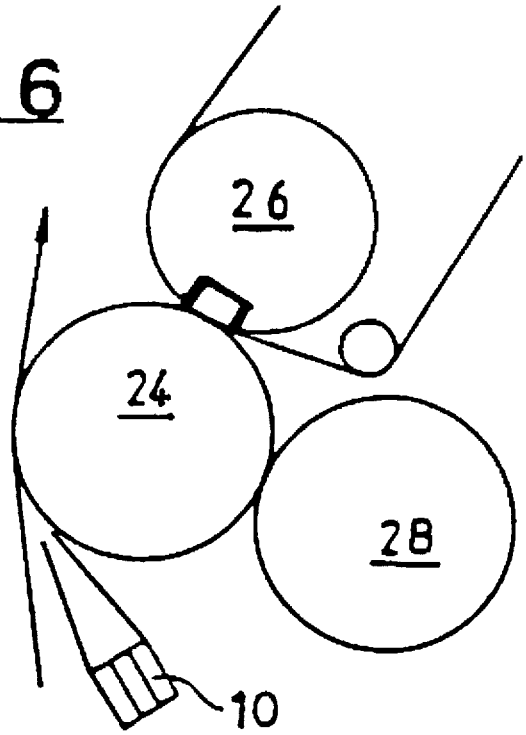

FIG. 6 shows a press unit of compact construction in accordance with the invention. In this case, pulp slurry is introduced via a headbox 10 between a felt and a smooth tubular roll 24. A long-nip press 26 lies against the smooth tubular roll 24. Following that, a next smooth roll 28 lies against the tubular roll 24 and transfers the paper to the following paper machine.

Figure 7:
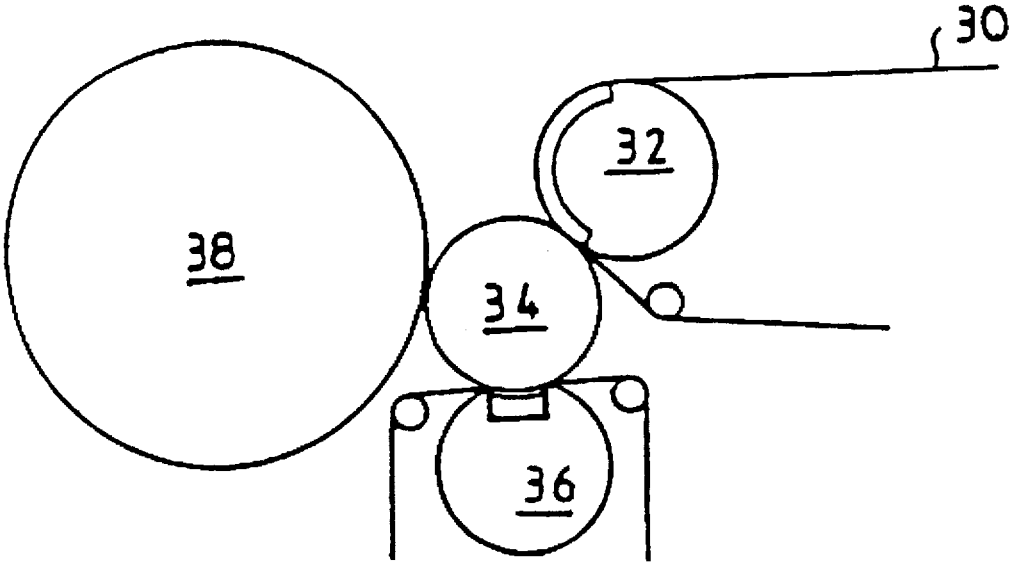

FIG. 7 shows the arrangement of the invention on the example of a paper machine for the production of crepe paper. There can be noted a belt 30, coming from the right, on which the web of paper is conducted. The belt is conducted together with the web of paper over a suction roll 32, which transfers the web of paper to a profiled roll 34 having a shell of rigid shape. While the belt 30 is returned over a reversing roller, the web of paper remains on the profiled roll 34 and is fed to a press nip formed by the profiled roll 34 and a long-nip press 36, from where the web continues to remain on the surface of the profiled roll and is then transferred to a crepe cylinder 38 which rests against the profiled roll 1.

We claim:

1. A section of a paper machine including a first machine portion comprising at least a portion of a press section of the papermaking machine, a second machine portion comprising at least a portion of a drying section directly following the press section, and a web transfer arrangement defining a web transfer region located between the first portion and the second portion of the papermaking machine, in which:

the press section comprises:

a rotatable, smooth surfaced, first tubular roll having a roll shell which is rigid and having a smooth peripheral outer surface which contacts a paper web directly, a felted second press roll, the first roll and the second roll being positioned to define a first press nip between them through which the paper web passes, the first roll constituting the last and final roll of the press section and the first press nip constituting the last and final press nip of the press section;

the press section being such that the paper web continues to traverse, past the first press nip, an unfelted portion of the first roll to the web transfer region;

the second portion comprises:

a leading, heated unfelted drying cylinder located adjacent the unfelted portion of the first tubular roll of the press section; and the web transfer arrangement between the first roll of the first portion and the drying cylinder of the second machine portion being such that the paper web is transferred directly from the first roll of the press section to the drying cylinder of the second machine portion without open draw, avoiding a free web path.

2. The paper machine section of claim 1, in which the drying cylinder of the second portion is a tissue drying cylinder.

3. The paper machine section of claim 1, wherein the second felted roll comprises a long nip roll past which a felt passes.

4. The paper machine section of claim 3, wherein the long nip press roll comprises a shoe press roll.

5. The paper machine section of claim 1, further comprising a fourth, felted press roll in contact with the smooth surface of the first roll for defining a second pre-press nip lying in front of the first press nip in the path of the web through the press section.

6. The paper machine section of claim 5 wherein separate respective felts are provided in and pass through each of the first and second press nips.

7. The paper machine section of claim 5, further comprising a single common felt passing through both of the first and the second pre-press nips.

8. The paper machine section of claim 5, wherein the fourth felted press roll for the pre-press nip comprises a suction roll having a suction zone around the fourth roll which lies predominately upstream in the web in front of the pre-press nip.

9. The paper machine section of claim 5, wherein the first smooth tubular roll is a sag adjustment roll.

10. The paper machine section of claim 1, wherein the first smooth tubular roll is a sag adjustment roll.

* * * * *